US005176807A

United States Patent [19]

Kumar

[11] Patent Number: 5,176,807

[45] Date of Patent: Jan. 5, 1993

[54] EXPANDABLE COIL CATHODIC PROTECTION ANODE

[75] Inventor: Ashok Kumar, Champaign, Ill.

[73] Assignee: The United States of America as represented by the Secretary of the Army, Washington, D.C.

[21] Appl. No.: 462,935

[22] Filed: Jan. 3, 1990

Related U.S. Application Data

[63] Continuation of Ser. No. 317,302, Feb. 28, 1989, abandoned.

[51] Int. Cl.[5] ..... C23F 13/00

[52] U.S. Cl. ..... 204/196; 204/147; 204/280; 204/290 F

[58] Field of Search ..... 204/147, 148, 196, 197, 204/280, 290 F; 267/166, 179, 74

[56] References Cited

U.S. PATENT DOCUMENTS

| | | | |
|---|---|---|---|
| 388,592 | 8/1888 | Siebel | 204/196 |
| 623,372 | 4/1899 | Hussey | 267/179 |
| 794,562 | 7/1905 | Stabe | 267/74 |
| 1,615,916 | 2/1927 | Ryder | 267/179 |
| 2,025,243 | 12/1935 | Jackson et al. | 204/147 |
| 2,286,254 | 6/1942 | Brault | 267/74 |
| 2,885,710 | 5/1959 | Brasty | 267/166 |
| 2,996,445 | 8/1961 | Eisenberg et al. | 204/196 |
| 3,038,849 | 6/1962 | Preiser | 204/196 |
| 3,135,677 | 6/1964 | Fischer | 204/196 |
| 3,336,942 | 8/1967 | Keith et al. | 267/179 |
| 3,366,400 | 1/1968 | Fitch | 267/179 |
| 3,379,630 | 4/1968 | Romans et al. | 204/147 |
| 3,632,498 | 1/1972 | Beer | 204/290 F |
| 3,846,273 | 11/1974 | Bianchi et al. | 204/290 F |
| 3,850,071 | 11/1974 | Itai et al. | 148/6.35 |
| 3,884,447 | 5/1975 | Alexander et al. | 267/166 |
| 3,948,751 | 4/1976 | Bianchi et al. | 204/290 F |
| 4,039,417 | 8/1977 | Sasaki et al. | 204/196 |
| 4,087,742 | 5/1978 | Khoo | 204/197 |
| 4,112,140 | 9/1978 | Heikel et al. | 427/126 |
| 4,214,971 | 7/1980 | Heikel et al. | 204/290 |
| 4,231,852 | 11/1980 | Ruckert | 204/196 |
| 4,255,647 | 3/1981 | Rickert et al. | 219/322 |
| 4,407,711 | 10/1983 | Baboian et al. | 204/196 |
| 4,434,039 | 2/1984 | Baboian et al. | 204/196 |
| 4,445,989 | 5/1984 | Kumar et al. | 204/147 |
| 4,452,683 | 6/1984 | de Nora et al. | 204/196 |
| 4,514,273 | 4/1985 | Vollman | 204/196 |

OTHER PUBLICATIONS

Ashok Kumar and Mark D. Armstrong, "Cathodic Protection Designs Using Ceramic Coated Anodes", Corrosion 88 Paper No. 30, National Assocation of Corrosion Engineers, St. Louis, Mo., Mar. 21-25, 1988, pp. 30/1-30/13.

Hock, et al., "Fabrication of Electrically Conductive Metal Oxide Coatings by Reactive Ion Plating", Journal of Vacuum Science, Technology, vol. 3, No. 6, Nov./Dec. 1985, pp. 2661-2664.

*Primary Examiner*—T. Tung

*Attorney, Agent, or Firm*—Darrell E. Hollis

[57] ABSTRACT

A cathodic protection system for a tank has an anode which comprises a long extendible coil of wire of a valve metal coated with a suitable electrically conductive ceramic material. The coil provides reduced electrolyte resistance and power consumption. At installation the coil is extended to provide the anode length desired for the particular tank. Each end of the anode can have insulation to provide the desired dielectric standoff. The insulation of the lower end can be in the form of a the weighted element to stabilize the position of the anode.

20 Claims, 2 Drawing Sheets

EXPANDABLE COIL CATHODIC PROTECTION ANODE

STATEMENT OF GOVERNMENT INTEREST

The invention described and claimed herein may be manufactured and used by or for the Government of the United States of America for governmental purposes without the payment of royalties thereon or therefor.

This is a continuation of application Ser. No. 07/317,302, filed Feb. 28, 1989, now abandoned.

FIELD OF THE INVENTION

The invention relates to cathodic protection for steel structures immersed in water such as tanks. In a specific aspect, the invention relates to cathodic protection for hot water heater tanks. In another aspect, the invention relates to a long cathodic protection anode structure with lower electrolyte resistance which can be expanded to the length desired for use in a particular size tank. In yet another aspect, the invention relates to a ceramic coated, expandable coil anode useful for cathodic protection of the interior surfaces of a water tank or a navigation lock structure.

BACKGROUND OF THE INVENTION

Hot water tanks with a small capacity, such as domestic hot water heaters, have generally been provided with a passive anti-corrosion layer, mostly of enamel or glass, and a sacrificial or donor anode of magnesium, zinc or aluminum. The sacrificial anode is usually screwed through a socket in the top of the tank at the time the tank is manufactured. Although coatings are a major form of corrosion control, no coating is perfect. All coatings have at least some porosity to water and chloride ions, in many cases through pinholes and other mechanical defects in the coating.

It is a well established fact that the life of a domestic hot water heater can usually be calculated based on the life of the sacrificial anode used to protect it from corrosion. The warranties associated with the water heater industry are based on some average theoretical life of the sacrificial anode or anodes installed by the water heater manufacturer. The water heaters with long warranties simply have more sacrificial anodes in them. When the anodes are expended (sacrificed), the life of the water heater from that point on is very tenuous. In some geographical areas, the water is so corrosive that the sacrificial anodes will not last six months, much less the life of the warranty on the tank. The corrosivity of the water to sacrificial anodes generally depends on electrical resistivity, pH, copper ions, oxygen concentration, water hardness, and other factors such as sulfate reducing bacteria. Sacrificial anodes are also generally ineffective for protecting the parts of the water tank which are remote from the anode. Thus, the size and shape of each tank is an important factor in determining the number of anodes and the size of anodes necessary to adequately protect the entire tank.

A commonly used corrosion prevention technique is cathodic protection, involving the application of a small electric current from an external source to the corrodible structure. The current is supplied through the cathodic anode and eventually consumes it. The anode is the positive terminal in the cathodic protection circuit, and the structure is the negative terminal. Many types of impressed current anodes are available. U.S. Pat. No. 3,379,630 discloses the use of coiled aluminum anodes, suspended vertically in an aluminum alloy tank containing alkali nitrate solution, in order to provide cathodic protection. However, the aluminum anodes are not considered to be suitable for use in hot water tanks. Silicon-iron and graphite have been in widespread use for the fabrication of cathodic anodes. However, these materials are brittle and have consumption rates on the order of 200 to 450 grams per ampere-year in contrast to consumption rates of 40 grams per ampere-year for cast magnetite and 0.01 gram per ampere-year for platinum coated titanium.

U.S. Pat. No. 4,039,417 discloses the use of a platinum coated titanium wire or a ferrite sintered body. Platinum has the lowest anodic dissolution rate of any material, but the dissolution rate increases substantially at elevated temperatures such as are encountered in hot water tanks. Platinum is also disadvantageous because of its very high cost and the susceptibility of a thin coating of platinum to erosion or abrasion. Whenever a substrate of a valve metal such as titanium, tantalum or niobium is exposed, a stable, passivating oxide film forms which prevents the flow of the current from the anode region where the platinum coating is interrupted. The ferrite ceramic materials have iron oxide as the principal component, and have good corrosion resistance, with a dissolution rate of 1 to 10 grams per ampere-year. However, the ferrite ceramic anodes are inherently brittle and are not acceptable where the anode might be mechanically damaged. The ferrite sintered body electrodes are usually cast as hollow cylinders with one end closed and the entire inner surface layered with electrodeposited copper to distribute the current evenly over the entire anode. They can also be produced as plates or rods. Generally, cast anodes produced by sintering are very brittle and are restricted in shape and size. This limits the feasibility of using such anodes for domestic water heaters, particularly with regard to the replacement market.

U.S. Pat. Nos. 4,407,711 and 4,434,039 disclose the use of an elongated anode having an outer layer of platinum, iridium, ruthenium or their alloys coated on a strand of titanium, columbium or tantalum disposed on an electrically insulative support One embodiment is an insulative polypropylene rod having an axially extending channel which receives the anode strands, while another embodiment has the anode strands wrapped helically about a tube. The noble metal is expensive, and the anode strands are readily subject to mechanical damage.

Conducting ceramic coatings are a relatively new concept in the field of impressed current anodes. The conducting ceramic anode coating must provide an effective barrier to oxygen ions, so that the substrate metal does not become oxidized In addition, the ceramic coating must have a relatively high electron conductivity on active surface area for oxidation to occur, be mechanically strong and have good adherence to the substrate. U.S. Pat. No. 3,850,701 describes the use of a magnetite coating which was chemically processed over a titanium or tantalum substrate. However, the resulting coating had insufficient adhesion to the substrate.

U.S. Pat. No. 4,445,989 discloses the use of a second type of ceramic anode. It employs a cathodic anode comprising an electrically conducting ceramic coating on a valve metal substrate, where the consumption rate of the ceramic coating is on the order of 1 gram per ampere-year. The ceramic coating is approximately 10 to 20 mils thick and is produced by plasma spraying. The ceramic coating is either ferrite or chromite, while the preferred valve metal substrates are titanium and niobium.

U.S. Pat. Nos. 3,846,273 and 3,948,751 describe titanium or niobium metal substrates coated with niobium-doped titanium oxide by conventional techniques. U.S. Pat. Nos. 4,112,140 and 4,214,971 disclose a ruthenium oxide-titanium oxide coating on a valve metal substrate produced by conventional techniques.

Later it was discovered that composite anodes having excellent characteristics of low resistivity, very low dissolution rates, long life, durability, and corrosion resistance can be produced by reactive ion plating a thin layer of mixed metal oxides on a self-passivating electrically conductive valve metal base. The mixed metal oxides are composed of transition metal oxides and/or noble metal oxides of the platinum group. The valve metal is generally titanium or niobium. Three preferred embodiments are a niobium-doped titanium oxide coating or a ruthenium oxide/titanium oxide mixture coating or an iridium oxide/titanium oxide mixture coating on a niobium or titanium valve metal substrate. The thickness of the coating is at least one micron and can be 50 microns or greater. The coating is preferably achieved by reactive ion plating in concert with predeposition sputter cleaning of the substrate surface.

U.S. Pat. No. 4,231,852 discloses the cathodic protection of a hot water tank wherein a reference electrode, positioned close to the tank wall, is used to control the current flowing through the cathodic anode. The reference electrode is positioned coaxially with the anode and both are supported by a common holder so that the combination can be inserted through a single opening in the tank wall.

SUMMARY OF THE INVENTION

It is an object of the present invention to provide a new and improved means for providing cathodic protection for a metal chamber. Another object of the invention is to provide an impressed current protection system for hot water tanks. It is an object of the invention to provide a hot water tank with a cathodic anode having a low consumption rate. Another object of the invention is to provide a cathodic anode which is adjustable in length to accommodate its use with various sizes of hot water tanks. A further object of the invention is to provide means for maintaining a coiled cathodic anode in an extended position while preventing contact of the anode with the tank wall.

In accordance with the present invention, a cathodic protection system for a tank is provided with an anode which comprises an extendible coil of wire of a valve metal coated with a suitable electrically conductive ceramic material. At installation, the coil is stretched out (extended) to provide the anode length desired for the particular tank. The portion of the anode adjacent the connection through the tank wall can be provided with a coating of an electrically non-conductive material to prevent current distribution imbalance in the top of the tank. The lower end of the anode can be provided with an electrically non-conductive body which serves as a stabilizing weight as well as preventing the anode from making electrical contact with the tank wall.

Other aspects, objects and advantages of the invention will be apparent from the following description and accompanying drawings.

DETAILED DESCRIPTION OF THE INVENTION

Figure 1:
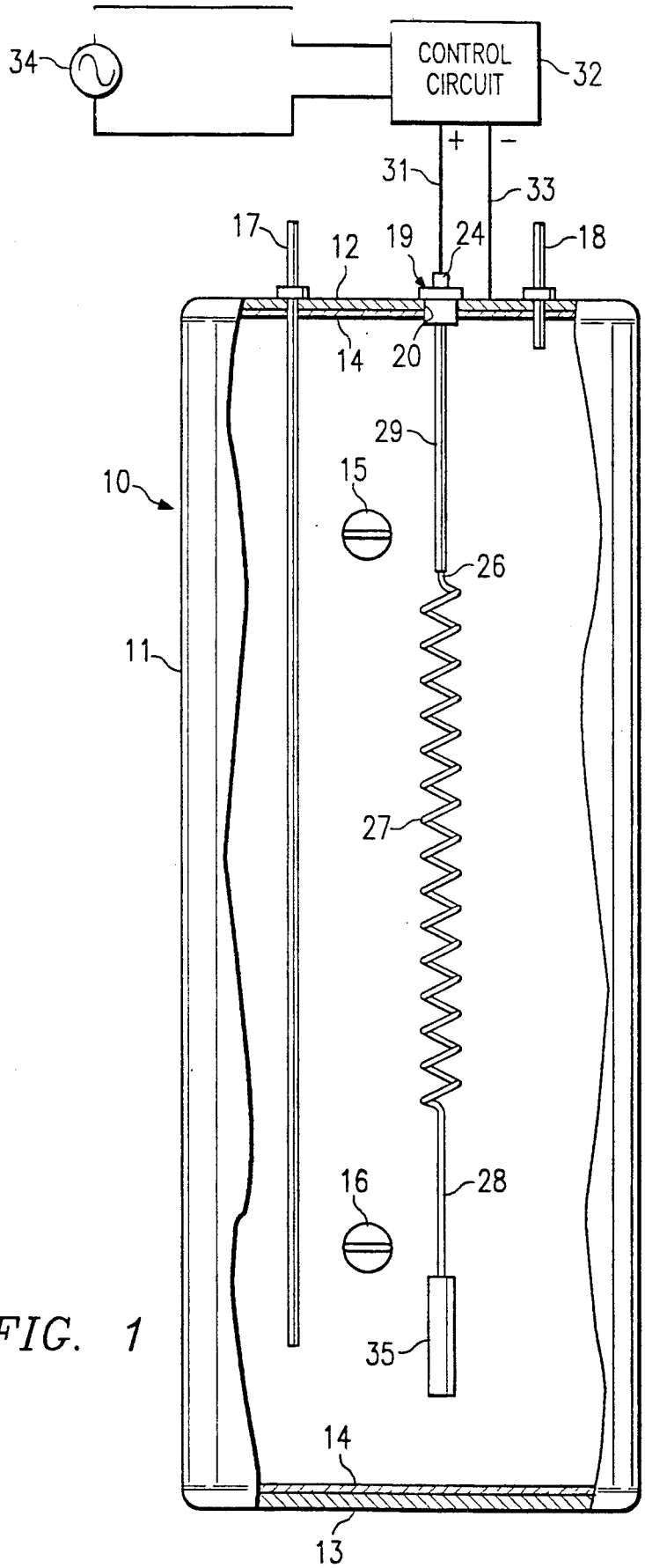
FIG. 1 is an elevational view, partly in cross-section, of a domestic hot water heat tank containing a corrosion protection device made in accordance with one embodiment of the present invention.

In the drawings, the shell of a conventional domestic hot water heating tank 10 comprises an annular vertical wall 11, a top end wall 12, and a bottom end wall 13 of conventional galvanically active material such as steel. The steel shell is lined with a coating 14 of glass, enamel, or other chemically inert material to provide passive protection against corrosion. The hot water heater is illustrated with conventional upper and lower electrical heating elements 15 and 16 which are connected to a suitable heater control circuit (not shown), but the invention is also applicable to gas fired hot water heaters. A cold water inlet conduit 17 extends downwardly through top end wall 12 to a point near the bottom of the tank, while hot water outlet conduit 18 extends downwardly through top end wall 12 to a point just below the top end wall 12. The casing for the hot water tank 10 and the thermal insulation located between the casing and the hot water tank 10 have been omitted from the drawing for simplicity in illustration.

Figure 2:
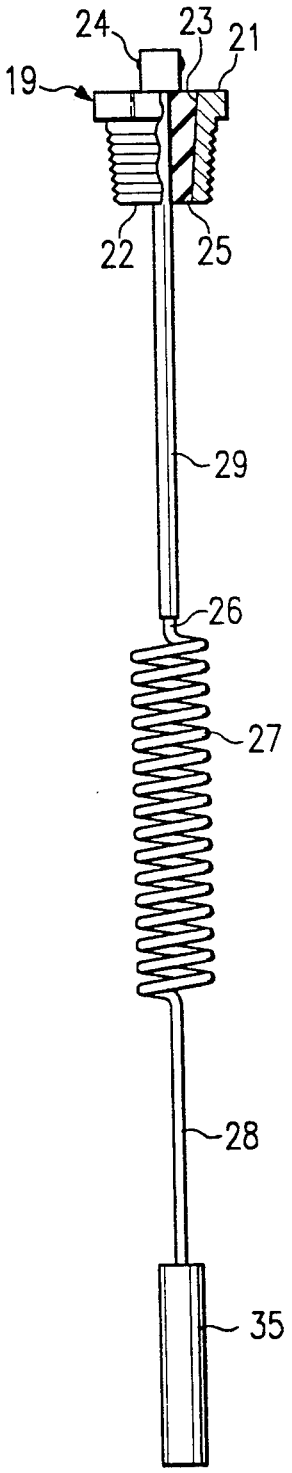
FIG. 2 is an elevational view of the corrosion protection device of FIG. 1 prior to installation in a hot water tank.

Referring now to FIGS. 1 and 2, a standard ¾ inch hex feed-through holder plug 19 is installed in threaded port 20 in top end wall 12 to close port 20 and to support the anode assembly in the tank. Plug 19 has a top surface 21 positioned outside of the tank 10, a bottom surface 22 positioned inside of the tank 10, and a channel 23 extending from the top surface 21 to the bottom surface 22. An electrical terminal 24 is positioned at least substantially coaxially with plug 19 and electrically insulated therefrom by suitable non-conducting material 25. An anode in the form of a titanium wire coated with an electrically conductive ceramic has a relatively straight upper segment 26, a helically coiled intermediate segment 27, and a relatively straight lower segment 28. The coil form of intermediate segment 27 provides a lower electrolyte resistance. The upper end of upper segment 26 is electrically connected to terminal 24, but is insulated from the plug 19 and shell 10 by insulation 29 and non-conductive material 25. Insulation 29, in the form of a continuous annular coating, surrounds the anode wire from the upper end of segment 26 downwardly along segment 26 a distance sufficient to provide the desired dielectric standoff to prevent current distribution imbalance in the upper portion of the hot water tank. Electrical lead 31 connects terminal 24 to the positive DC voltage output of a suitable control circuit 32, while electrical lead 33 connects the steel shell of tank 10 to the negative DC voltage output of control circuit 32. The control circuit 32 can be powered by a suitable AC source 34.

The cathodic anode assembly is illustrated in FIG. 2 in its pre-installation condition wherein intermediate segment 27 is at its original or "as-manufactured"

length. Just prior to installation of the cathodic anode in the hot water tank, the installer grasps the upper and lower segments 26 and 28 and exerts, either manually or with suitable equipment, axial forces directed away from intermediate segment 27, to thereby extend the length of the coiled intermediate segment until the total length of the anode is that which is desired for the tank in which it is to be installed. A stabilizing element 35 is secured to the lower end of lower anode segment 28. Element 35 has a weight appropriate to maintain the extended anode in the desired vertical position under normal conditions, as shown in FIG. 1, for the minimum resistance and best current distribution to prevent localized over-protection and to provide optimum cathodic protection of the hot water tank. Element 35 is made of a suitable electrically non-conducting material, such as sand filled polyethylene, to prevent electrical contact between anode segment 28 and the inner surface of the hot water tank in any unusual circumstances such as the hot water tank being jostled. The vertical length of element 35 is sufficient to provide the desired dielectrical standoff in order to prevent localized over-protection at the tank bottom. The element 35 is preferably suspended at least an inch above the inside surface of bottom wall 13, to prevent rubbing contact with lining 14 in the event of vibration being imparted to the hot water tank.

The anode wire comprises a substrate core of a suitable valve metal with a continuous annular coating of a suitable electrically conductive ceramic. Titanium is preferred for use as the substrate in tap water environments. Instead of a solid core of titanium, the core can be a copper wire having a continuous annular coating of titanium around the copper. The ceramic coating can be made from any suitable mixture of transition metal oxides and/or noble metal oxides of the platinum group. Ruthenium oxide and iridium oxide exhibit metallic electrical conductivity over a wide range of temperatures, have very low resistivities and very low dissolution rates. Alloying ruthenium oxide and/or iridium oxide with titanium oxide provides a solid solution with increased chemical stability without significantly degrading the electrical conductivity. These materials are far more resistant to abrasion than platinum clad anodes. The mixed metal oxide anodes can be fabricated by a variety of ceramic processing techniques. The presently preferred ceramic material is formed from a mixture of titanium oxide with either ruthenium oxide or iridium oxide wherein the ruthenium or iridium constitutes from about 20 to about 80 percent of the metal atoms in the ceramic material while titanium constitutes from about 80 to about 20 percent of the metal atoms in the ceramic material. A particularly useful ceramic material has ruthenium or iridium constituting from about 40 to about 50 percent of the metal atoms with titanium constituting from about 60 to about 50 percent of the metal atoms. This ceramic material may be a mixed oxide of rutile titanium dioxide and ruthenium dioxide. Another suitable ceramic is a niobium-doped titanium oxide ceramic material generally having titanium constituting 90 to 99.5 percent of the metal atoms with niobium constituting from 10 to 0.5 percent of the metal atoms. The niobium-doped titanium dioxide may be a mixture of various niobium oxides or a solid solution of titanium dioxide with niobium atoms incorporated in the rutile lattice.

The ceramic coating is preferably applied by reactive ion plating one or more layers of the metal oxide on a titanium wire substrate. The ceramic coating will generally have a thickness in the range of about 0.001 inch to about 0.050 inch, while the valve metal core will generally have a diameter in the range of about 0.05 inch to about 0.5 inch.

Figure 3:
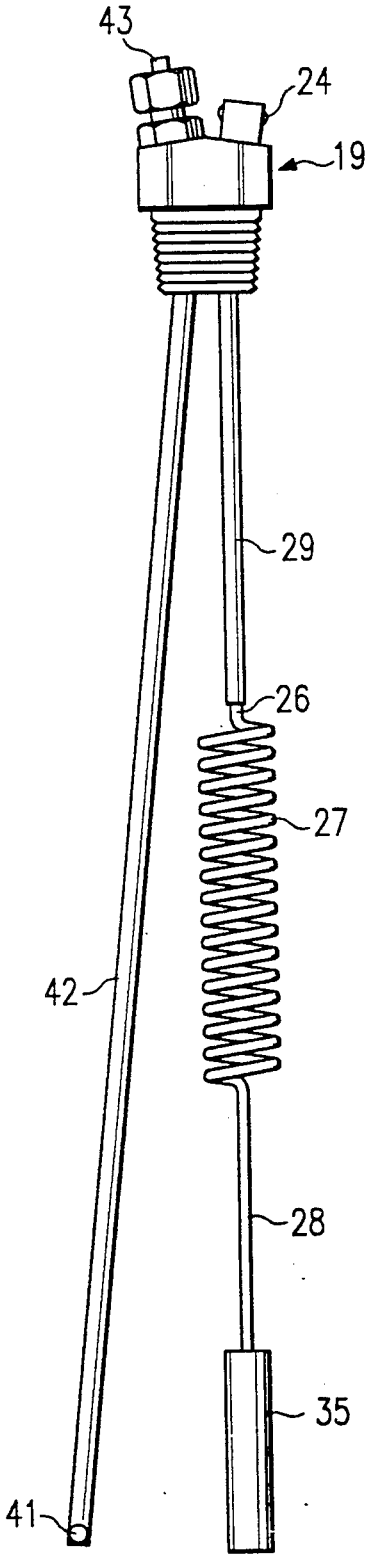
FIG. 3 is an elevational view of a corrosion protection device, in its pre-installation state, in accordance with another embodiment of the present invention.

Control circuit 32 can have an adjustable voltage setpoint via a potentiometer to accommodate different degrees of water corrosivity along with constant voltage regulation for both load and line changes at any setpoint. Control circuit 32 can be adjusted to provide the desired constant voltage level. The desired value can be determined by temporarily opening the relief valve port, inserting a suitable reference cell, and turning off the power to the cathodic anode for a moment to permit the measurement of the polarization potential. Since polarization potential adjustment is not easily accomplished or practical with sacrificial anodes, over-protection is sometimes experienced with the use of sacrificial anodes, which can cause premature water heater failure. However with the present invention, it is possible to optimize the corrosion mitigation for domestic hot water heaters. This can be accomplished even more readily with the embodiment of FIG. 3, wherein elements common to FIG. 2 are designated by the same reference numerals. A polarization test point sensor 41 is positioned at the lower end of probe 42. The upper end of probe 42 extends through pass-through hex plug 19 to provide a terminal 43 which is electrically connected to sensor 41, but electrically isolated from plug 19 and tank shell 10. A suitable reference cell, (not shown) such as a conventional copper sulfate cell, can be placed into contact with terminal 43, and the power to cathodic anode can be turned off for the short length of time necessary to take the polarization potential reading.

If desired, control circuit 32 can take the form of a diode imbedded in the insulating material 25, to provide a constant current at a constant voltage, or it can employ four diodes in a bridge in combination with a rheostat to provide an adjustable current level. Control circuit 32 can have current limiting means for short circuit protection.

The invention is particularly advantageous for use in replacing sacrificial anodes in existing installations. After removing the remains of the old sacrificial anode, the extendable coil anode of the present invention can be stretched out to provide an anode length just short of the interior height of the hot water heater tank and inserted into the tank through the sacrificial anode port, and the pipe plug screwed into place to seal the port. In situations where the water outlet port of the tank is to double as the anode port, a pipe tee can be employed to accommodate the cathodic anode and the hot water flow. The present invention provides a "one size fits all," extendible, anode which can be adjusted to the desired length for the tank in which it is to be installed. It provides a light weight, electrically conductive metal oxide anode with a very low dissolution rate, which can have a life of more than fifty years for coated domestic hot water tanks.

Although a preferred embodiment of the invention has been described in the foregoing detailed description and illustrated in the accompany drawings, it will be understood that the invention is not limited to the embodiment disclosed, but is capable of numerous rearrangements, modifications, and substitutions of parts and elements without departing from the spirit of the invention. The present invention is therefore intended to encompass such rearrangements, modifications and substitutions of parts and elements as fall within the spirit and scope of the invention.

What is claimed is:

1. An anode assembly suitable for insertion through an opening in the top of a chamber forming structure to provide impressed current cathodic protection of the interior surface of the chamber, which comprises:

a holder plug for securing the anode assembly to the structure and closing said opening, said holder plug having a top surface which would be positioned outside of the chamber and a bottom surface which would be positioned inside of said chamber, said holder plug having a channel extending therethrough from said top surface to said bottom surface;

an electrical connector;

an anode wire having a substantially straight upper segment, an intermediate segment and a substantially straight lower segment, said upper segment extending through said channel, but spaced from said holder plug, with the upper end of the upper segment being electrically connected to said electrical connector;

electrically non-conductive material being positioned in said channel to close said channel and to physically support said electrical connector and said anode wire in electrical isolation from said holder plug;

said upper segment of said anode wire having a continuous coating of electrically insulating material thereon extending at least from said electrically non-conductive material downwardly a substantial distance along the length of said upper segment;

said intermediate segment of anode wire being in the form of an extendible helical coil;

a stabilizing element secured to the lower end of said lower segment to prevent electrical contact between said lower segment and the adjacent surface of the chamber, said stabilizing element being formed of electrically non-conductive material and having a weight which is sufficient to maintain said helical coil in an extended position; and said anode wire comprising an elongated valve metal substrate with a continuous annular coating thereon of an electrically conductive ceramic material.

2. An anode assembly in accordance with claim 1 wherein said ceramic material is formed from a mixture of ruthenium oxide and titanium oxide.

3. An anode assembly in accordance with claim 2 wherein said valve metal comprises titanium.

4. An anode assembly in accordance with claim 1 wherein said ceramic material is formed from a mixture of iridium oxide and titanium oxide.

5. An anode assembly in accordance with claim 4 wherein said valve metal comprises titanium.

6. An anode assembly in accordance with claim 4 wherein said valve metal comprises niobium.

7. An anode assembly in accordance with claim 1 wherein the distance which said coating of electrically insulating material extends along said upper segment of anode wire is sufficiently great to prevent significant current distribution imbalance in the upper portion of the tank.

8. An anode assembly in accordance with claim 7 wherein the length of said stabilizing element in the axial direction of said lower segment of anode wire is sufficiently great to minimize localized over-protection of the bottom portion of the tank.

9. An anode assembly in accordance with claim 1 further comprising a probe extending downwardly through said channel and electrically isolated from said holder plug and from said anode wire and having a polarization sensor at the end of said probe remote from said holder plug to sense the potential inside the chamber.

10. In a water heater comprising:

a water tank having a shell wall with an inner wall surface;

a passive anticorrosive layer on said inner wall surface;

a first conduit extending through said shell wall to permit entry of water into said water tank;

a second conduit extending through said shell wall to permit the outflow of water from said water tank;

means associated with said water tank for heating water contained within said water tank; and a cathodic protection device having an anode positioned with said water tank, the improvement wherein said cathodic protection device comprises:

a holder plug securing the cathodic protection device to the tank, said holder plug having a top surface which is positioned outside of the tank and a bottom surface which is positioned inside of said tank, said holder plug having a channel extending therethrough from said top surface to said bottom surface;

an electrical connector;

an anode wire having a substantially straight upper segment, an intermediate segment and a substantially straight lower segment, said upper segment extending through said channel, but spaced from said holder plug, with the upper end of the upper segment being electrically connected to said electrical connector;

electrically non-conductive material being positioned in said channel to close said channel and to physically support said electrical connector and said anode wire in electrical isolation from said holder plug;

said upper segment of said anode wire having a continuous coating of electrically insulating material thereon extending at least from said electrically non-conductive material downwardly a substantial distance along the length of said upper segment;

said intermediate segment of anode wire being in the form of an extendible helical coil;

a stabilizing element secured to the lower end of said lower segment to prevent electrical contact between said lower segment and the adjacent surface of the tank, said stabilizing element being formed of electrically non-conductive material and having a weight which is sufficient to maintain said helical coil in an extended position; and said anode wire comprising an elongated valve metal substrate with a continuous annular coating thereon of an electrically conductive ceramic material.

11. A water heater in accordance with claim 10 wherein said ceramic material is an alloy of ruthenium oxide and titanium oxide.

12. A water heater in accordance with claim 11 wherein said valve metal comprises titanium.

13. A water heater in accordance with claim 10 wherein said ceramic material is a mixture of iridium oxide and titanium oxide.

14. A water heater in accordance with claim 13 wherein said valve metal comprises niobium.

15. A water heater in accordance with claim 13 wherein said valve metal comprises titanium.

16. A water heater in accordance with claim 10 wherein the distance which said coating of electrically insulating material extends along said upper segment of anode wire is sufficiently great to prevent significant current distribution imbalance in the upper portion of the tank.

17. A water heater in accordance with claim 16 wherein the length of said stabilizing element in the axial direction of said lower segment of anode wire is sufficiently great to minimize localized over-protection of the bottom portion of the tank.

18. A water heater in accordance with claim 10 further comprising a probe extending downwardly through said channel and electrically isolated from said holder plug and from said anode wire and having a polarization sensor at the end of said probe remote from said holder plug to sense the potential inside the tank.

19. A water heater in accordance with claim 10 wherein said elongated valve metal substrate comprises a continuous coating of titanium on an elongated copper core.

20. A water heater in accordance with claim 19 wherein said ceramic material comprises iridium oxide and titanium oxide.

* * * * *